US011160426B1

(12) United States Patent
Williamson

(10) Patent No.: US 11,160,426 B1
(45) Date of Patent: Nov. 2, 2021

(54) AMALGAMATED HANDHELD VACUUM APPLIANCE DUSTING ATTACHMENT

(71) Applicant: Kathleen J. Williamson, East Stroudsburg, PA (US)

(72) Inventor: Kathleen J. Williamson, East Stroudsburg, PA (US)

( * ) Notice: Subject to any disclaimer, the term of this patent is extended or adjusted under 35 U.S.C. 154(b) by 250 days.

(21) Appl. No.: 15/910,848

(22) Filed: Mar. 2, 2018

Related U.S. Application Data

(60) Provisional application No. 62/466,039, filed on Mar. 2, 2017.

(51) Int. Cl.

| | |
|---|---|
| ***A47L 5/24*** | (2006.01) |
| ***A47L 9/06*** | (2006.01) |
| ***A47L 11/08*** | (2006.01) |
| ***A47L 9/28*** | (2006.01) |
| ***A47L 9/24*** | (2006.01) |
| *A47L 9/04* | (2006.01) |
| *A47L 9/32* | (2006.01) |

(52) U.S. Cl.
CPC ..... *A47L 9/068* (2013.01); *A47L 9/06* (2013.01); *A47L 9/066* (2013.01); *A47L 9/0633* (2013.01); *A47L 9/248* (2013.01); *A47L 9/2852* (2013.01); *A47L 11/08* (2013.01); *A47L 5/24* (2013.01); *A47L 9/0422* (2013.01); *A47L 9/0613* (2013.01); *A47L 9/325* (2013.01)

(58) Field of Classification Search
CPC ..... A47L 9/02; A47L 9/0633; A47L 9/066; A47L 9/068; A47L 9/242; A47L 9/246; A47L 9/327; A47L 5/24; A47L 9/24; A47L 9/06; B08B 2203/0247; Y01T 16/476
USPC ..... 15/416
See application file for complete search history.

(56) References Cited

U.S. PATENT DOCUMENTS

| | | | | |
|---|---|---|---|---|
| 986,245 A | | 3/1911 | Thurman | |
| 1,860,854 A | * | 5/1932 | Engberg | A47L 9/02 15/416 |
| 2,198,339 A | | 4/1940 | Hamilton | |
| 2,584,515 A | | 2/1952 | Udell | |

(Continued)

FOREIGN PATENT DOCUMENTS

| | | |
|---|---|---|
| DE | 102007006389 A1 | 10/2008 |
| EP | 0180367 A3 | 5/1986 |

(Continued)

*Primary Examiner* — Bryan R Muller
(74) *Attorney, Agent, or Firm* — Clinton H. Wilkinson; Wilkinson Law Office

(57) ABSTRACT

An amalgamated handheld vacuum dusting attachment having a housing shaped similar to a computer mouse for hand or distant cleaning featuring a crevice tool, a bristled brushing tool, and a non-bristled detachable cap having an ergonomically shaped top. Separated suction vents are provided for the crevice and bristled tools in order to provide maximum suction, and 360° rotatable wheels, lights, battery chamber, on/off switch, and battery recharge pin port are also provided. Also provided is a padded wrist support end cap and integrated swiveling end coupling nozzle, which can be detached for use as an independent brushless vacuum dusting device. An additional 360° manually rotating stabilizing wand, and independent accordion hose with ergonomic grip disk and handled vacuum attachment for use with aforesaid dusting attachment, are provided.

15 Claims, 9 Drawing Sheets

(56) References Cited

U.S. PATENT DOCUMENTS 2,606,338 A 8/1952 De Lorenzo
2,811,738 A 11/1957 Gall
2,953,808 A * 9/1960 Carmack ..... A47L 11/4036 15/365
3,147,509 A 9/1964 Sieb
4,053,962 A 10/1977 McDowell
4,161,802 A 7/1979 Knight et al.
4,332,051 A * 6/1982 LaMonte ..... A47L 4/02 15/328
4,459,720 A * 7/1984 Ahlf ..... A47L 9/02 15/398
4,553,284 A 11/1985 Strumbos
4,694,529 A 9/1987 Choiniere
4,723,338 A * 2/1988 Otsubo ..... A47L 9/02 15/331
4,776,059 A * 10/1988 Worwag ..... A47L 9/02 15/331
4,997,209 A 3/1991 McGrath et al.
5,046,218 A * 9/1991 Cerri ..... A47L 9/06 15/344
5,050,266 A 9/1991 Schneider
5,060,341 A 10/1991 Nelle
5,123,142 A 6/1992 Miller
5,502,870 A 4/1996 Ragner et al.
5,533,230 A 7/1996 Rouda
D405,570 S 2/1999 Broecking
6,026,541 A 2/2000 Bailey et al.
6,032,328 A * 3/2000 Harmon ..... A47L 9/02 15/416
6,044,521 A 4/2000 Sebek
6,370,731 B1 4/2002 Carter
6,375,227 B1 * 4/2002 Brenner ..... F16L 35/00 285/316
6,581,974 B1 * 6/2003 Ragner ..... A47L 9/242 285/12
D491,326 S 6/2004 Schroter
6,802,104 B1 10/2004 Redd
D513,101 S 12/2005 Allard et al.
7,784,137 B2 8/2010 Knopow
7,784,149 B2 8/2010 Schwarz et al.
8,402,604 B2 * 3/2013 Dant ..... A47L 9/0072 15/373
D733,376 S 6/2015 Bennett et al.
2002/0092118 A1 * 7/2002 Nunzio ..... A47L 5/24 15/329
2006/0085944 A1 * 4/2006 Lee ..... A47L 5/24 15/339
2006/0213025 A1 * 9/2006 Sawalski ..... A47L 5/14 15/344
2006/0272123 A1 * 12/2006 Di Nicolantonio ..... B23B 47/00 15/415.1
2007/0209154 A1 9/2007 Griffith et al.
2008/0086834 A1 4/2008 Schwarz et al.
2009/0165239 A1 * 7/2009 Frantzen ..... A47L 5/24 15/344
2009/0172912 A1 7/2009 Knopow
2009/0229070 A1 * 9/2009 Medema ..... A47L 9/0613 15/344
2010/0170060 A1 7/2010 Eccardt et al.
2010/0306954 A1 12/2010 Coscarella
2011/0138568 A1 * 6/2011 Hsu ..... A47L 9/0072 15/339
2012/0272473 A1 * 11/2012 Griffith ..... A47L 9/0416 15/339
2015/0223656 A1 8/2015 Tucker et al.
2016/0242612 A1 * 8/2016 Graves ..... A47L 9/244
2017/0071433 A1 * 3/2017 Millington ..... A47L 9/327

FOREIGN PATENT DOCUMENTS

EP 0377801 A1 7/1990
EP 0931498 A1 7/1999
ES 2199000 A1 2/2004
FR 2739275 A1 4/1997
GB 2276311 A 9/1994
JP 09327423 A 12/1997
WO 2002000086 A2 1/2002
WO 2008048552 A2 4/2008

* cited by examiner

AMALGAMATED HANDHELD VACUUM APPLIANCE DUSTING ATTACHMENT

FIELD OF THE INVENTION

The present invention relates generally to attachments and accessory tools for household vacuum cleaners, and more particularly to a multi-chambered ergonomic vacuum dusting attachment including a crevice tool and a dual use detachable cap end and swivel nozzle, as well as a 360° manually rotating stabilizing wand, and an independent adjustable accordion hose attachment.

BACKGROUND OF THE INVENTION

Suction-type surface cleaning appliances such as vacuum cleaners for cleaning floors, upholstery, and other areas in a home or workplace are generally known. The most popular household vacuum cleaners are either upright-standing or canister-style vacuum cleaners, although other more specialized types such as handheld vacuums, central air vacuum systems, electric brooms, and shop vacuums are also available. Household vacuum cleaners typically include a primary electrically motorized surface cleaning component for cleaning floor areas. Traditional upright standing vacuums have a separate hose extension for alternately connecting vacuum attachments, while in canister-type vacuums, typically the surface cleaning component is connected by a rigid conduit to a handle, which handle in turn is connected to the suction unit or canister by a flexible hose, such that the surface cleaning component and rigid conduit can be detached from hose and handle and used with other vacuum attachments. In both vacuum types, the hose and the vacuum attachments thereby are used to collect dirt, dust, and debris that cannot be obtained by the primary electrically motorized surface cleaning component.

The usual assortment of single purposed vacuum dusting attachments provided with the purchase of a vacuum cleaning machine are a crevice tool, a small bristled dusting tool, a small brushless dusting tool, and a wider bristled dusting tool suitable for larger surfaces such as wood flooring. Additional rigid extension hoses may be purchased as well. The manufacturers of the vacuum cleaning machines usually try to accommodate a storage place for the originally supplied vacuum dusting attachments, but Consumers often purchase additional purposed attachments since the attachments provided with the purchase are not adequate for all cleaning purposes. For example, a Consumer may purchase an additional attachment with swiveling or angled features to clean the upper surface of a ceiling fan. When the Consumer actually is in the process of vacuuming, these attachments have to be transported around while cleaning, it takes time for the Consumer to change the different attachments out to solve different dusting chores, and a place to store the vacuum attachments while not in use is required. Ideally, vacuum dusting attachments would be created which would sufficiently serve several purposes within one attachment, which would eliminate storage, the transport of many, and the time it takes to change out the attachments while in the process of cleaning.

While the Consumer is engaged in cleaning, problems are encountered particularly where close up cleaning is desired, especially when the hand has to hold the attachment in cleaning, such as when cleaning the top surface of a couch cushion. The Consumer is now forced to try to vacuum with vacuum dusting attachments that do not provide any place for the Consumer to comfortably hold the attachment. The Consumer therefore must hold on to an oddly shaped attachment or wrap their hands around a hard-circular extension or coupler hose, usually with the hand holding the uneven area where the attachment's end nozzle is attached to the hard coupler of the hose that originates out of the vacuum. The vacuum dusting attachments available on today's market are awkward to use and have no flexibility in movement where the Consumer has to use their own motions of wrist, hands, and body to move the attachment. Further, those who have afflictions such as osteoporosis, carpal tunnel, or such, may experience significant pain. In frustration, a Consumer will then switch to dusting with other devices at hand, such as rags, spray cleaning applications, and feather dusters, of which most of the dust escapes into the surrounding environs while creating additional items to carry while cleaning. This problem also arises when additional hard extension hoses are added between the vacuum attachment and the vacuum cleaner while trying to dust areas too far to reach such as high ceilings and tops of furniture. Now the Consumer encounters an attachment at a distance where the vacuum attachment's open aperture is hard to maneuver into the correct position, and also is faced with moving a rigid hose/s into position. It might necessitate the Consumer to bring the whole assembly of attachment and hoses back down towards them in order to adjust the vacuum attachment into another position or proper angle, especially since the aperture's one opening is usually quite small in size. Further, the Consumer while using rigid extension hoses has to overcome the limitations set by the standard length of the hoses and their non-movement except in one direction. The hose length when too short or too long is more likely to cause accidents such as, for example, the Consumer falling off a chair trying to compensate for hose shortness, or backing up to far and falling backwards down stairs to compensate for a hose being too long.

Another problem with vacuum dusting attachments on the current market is that mostly there is non-existing or inadequate lighting incorporated in the individual attachments themselves which would facilitate better seeing the dusting area to be cleaned, especially areas that are in shadow such as behind other items on a shelf, or the reduced lighting due to the time of day. Usually only the motorized primary surface cleaning component is complemented with lighting to light up the area directly in front of it to be vacuumed which primarily is the floor area, but it would especially be an advantage to have peripherally overall lighting on an attachment to be able to see all surrounding areas that are being vacuumed, thus speeding up and improving the cleaning process. The advantages of including lighting on an attachment itself are twofold, as it lights up the area to be dusted, and the emitted lighted beams allow the Consumer to actually see and confirm that the dust nodes/particles are being sucked up into the vacuum attachment. Unfortunately, because of the lack of proficient lighting on vacuum attachments, a Consumer might devise to precariously place a lamp closer to an area, or employ the uncoordinated use of a flashlight to obtain the same results.

Since the majority of the vacuum dusting attachments on the market today are designed to provide one specific cleaning chore, such as for example, a crevice tool for the sides of cushions, brushes affixed on a vacuum attachment to vacuum the top of the cushions, and a brushless vacuum attachment for drapery cleaning, and so forth, the Consumer is tasked with additional cleaning time to change out different attachments for each cleaning chore, use physical expenditure in repeated movements to collect debris owing to a small aperture attachment, transport many vacuum dusting attachments, suffer uncomfortable use of the vacuum dusting attachments due to the lack of proper hand holds, insufficient lighting, causing vacuuming with vacuum dusting attachments to become a frustrating, sometimes painful, time consuming and undesirable chore.

BRIEF SUMMARY OF THE INVENTION

It is a primary intention of the present invention to provide in an embodiment a superior amalgamated vacuum dusting attachment that will replace three individual standard vacuum attachments: a pull-out/push-in crevice tool, a bristled brush tool with 360° rotating wheels and lighting, and an optional detachable brushless tool with a back end swivel nozzle with lock, while also providing a comfortable place for the Consumer to hold the attachment while engaged in close up dusting/cleaning, and an additional recharging pin port for optional recharging capabilities. Further it is another primary intention to provide the amalgamated vacuum dusting attachment in an embodiment with more flexibility in movement by use of two separately devised attachments: a 360° rotating stabilizing wand with handles, and a flexible accordion hose.

In accordance with the present invention as featured in the Figure drawings, a computer mouse-like hand held vacuum attachment is devised. The vacuum attachment can be used by holding the top when close up cleaning is desired or attached on to hose extensions to clean distant areas. When the vacuum attachment is used for close up cleaning, the Consumer's hand can hold comfortably on to an ergonomically shaped top padded with non-slip material. The attachment moves with the hand by use of 360° rotatable wheels provided where the wheels also provide height and less resistance as the brushes below sweep debris. While trying to reach tight narrow spaces, the crevice tool which has its own intact vent, can be pulled out for use. When for example drapery needs to be cleaned the back brushless cap can be detached. The vacuum attachment provides lighting to the cleaning area with two battery powered light fixtures activated by an on/off switch, of which the battery has the option to be recharged through a rechargeable pin port. When a brushless vacuum attachment is required, the back cap may be detached and used. The back end features a swivel nozzle which allows freedom of swinging motion as the Consumer cleans, and added distance is provided with the accordion hose attached. When the Consumer needs to place the attachment to a hose for distance cleaning, the swivel option can be locked, and the accordion hose may be bent, and along with the manually rotating stabilizing wand the attachment and its open aperture can be positioned where needed for cleaning.

Further, it is intended that when the vacuum dusting device is being used at a distance when attached to an extension hose, preferably to the accordion hose presented, both the vacuum dusting device and accordion hose/s can be easily stabilized and maneuvered by using the 360° manually rotating stabilizing wand placed at the bottom of the assembled parts.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following detailed description is of the best mode or modes of the invention presently contemplated. Such description is merely exemplary in nature and is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
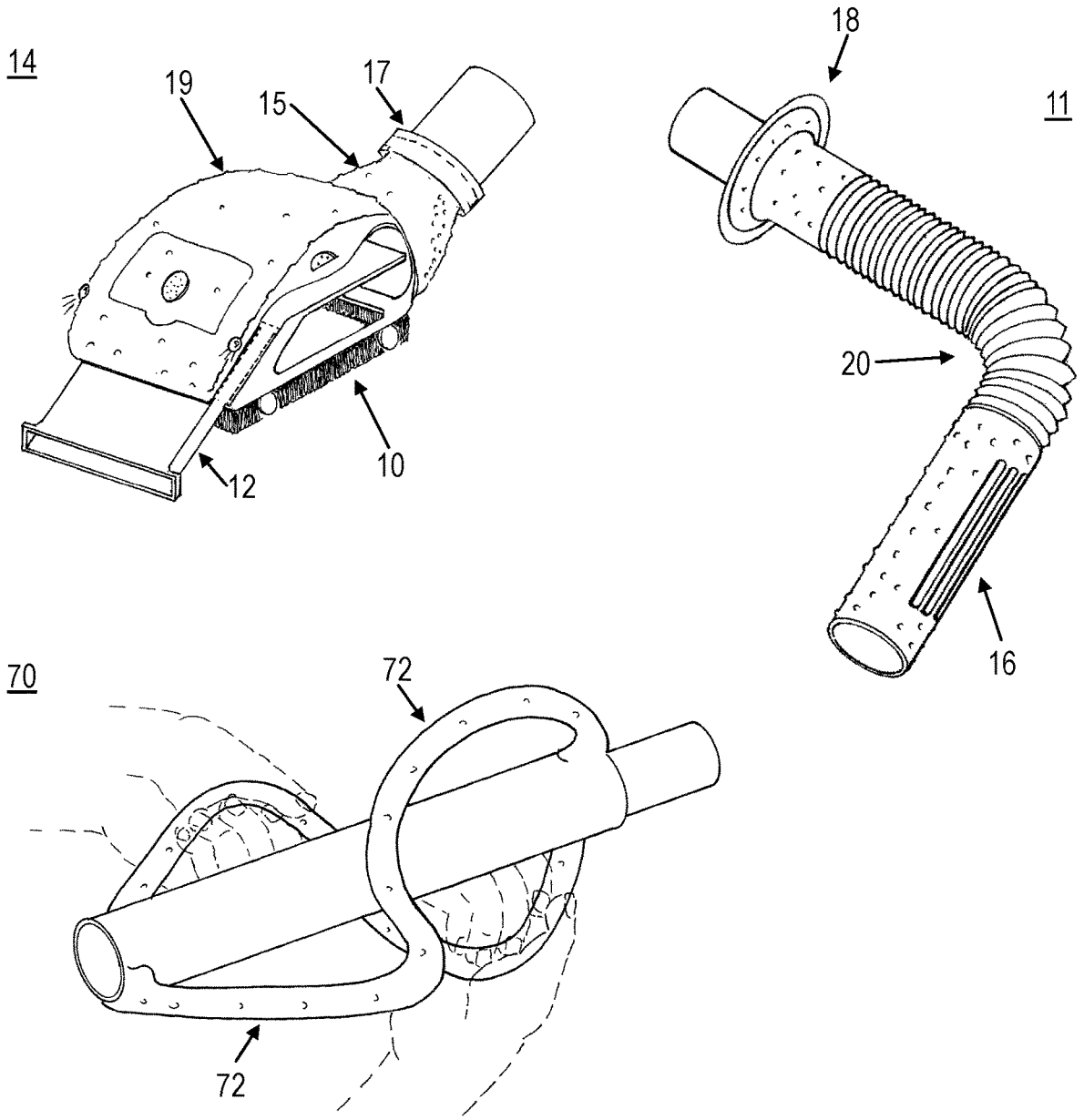
FIG. 1 is a perspective view of a vacuum dusting attachment, optional use accordion hose vacuum attachment, and a 360° manually rotating stabilizing wand according to the present invention.
Figure 9:
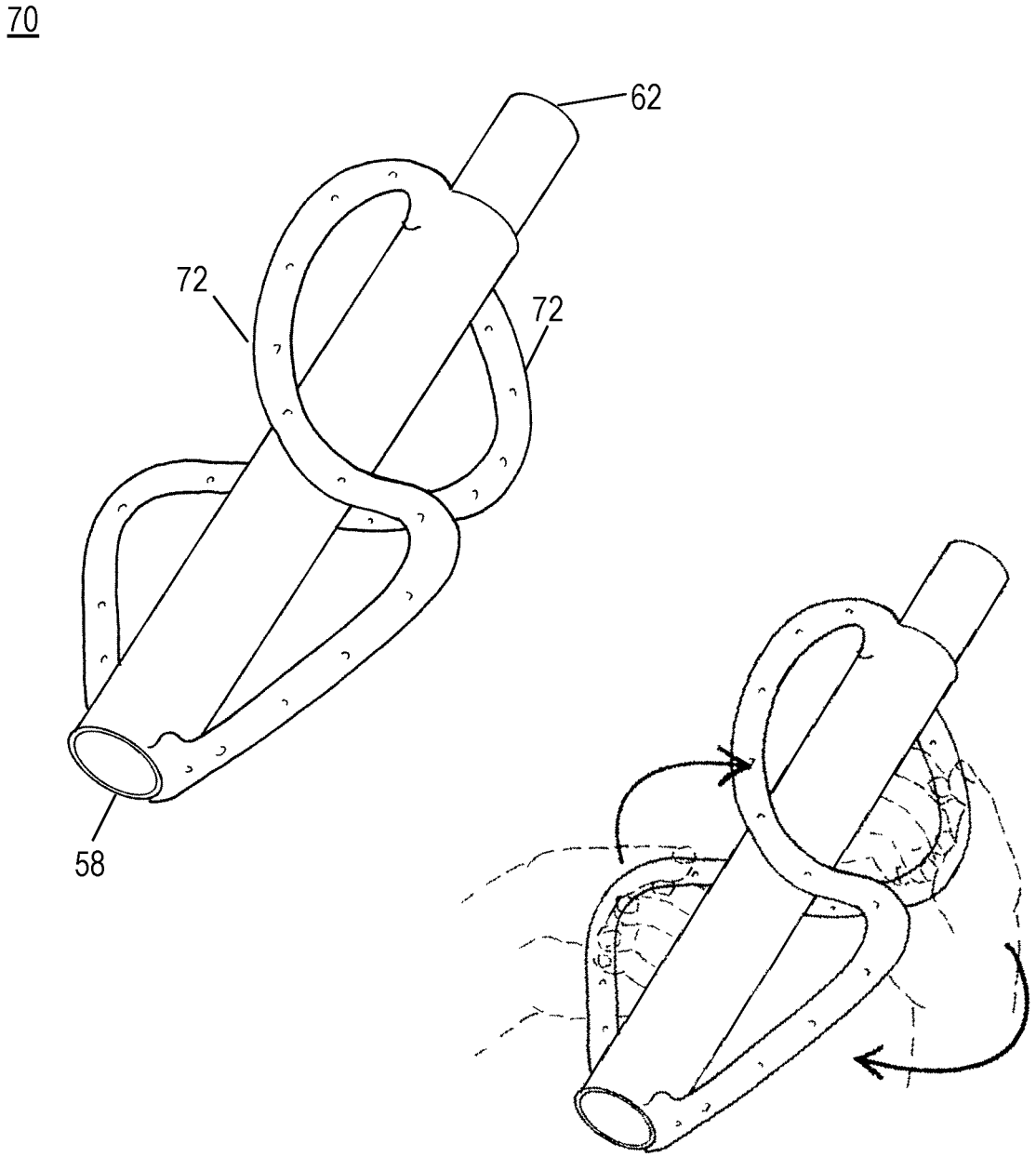
FIG. 9 illustrates a 360° manually rotating stabilizing wand in accordance with the invention and how the wand is gripped and rotated 360° in either left or right directions while the hands switch from handle to handle.
Figure 10:
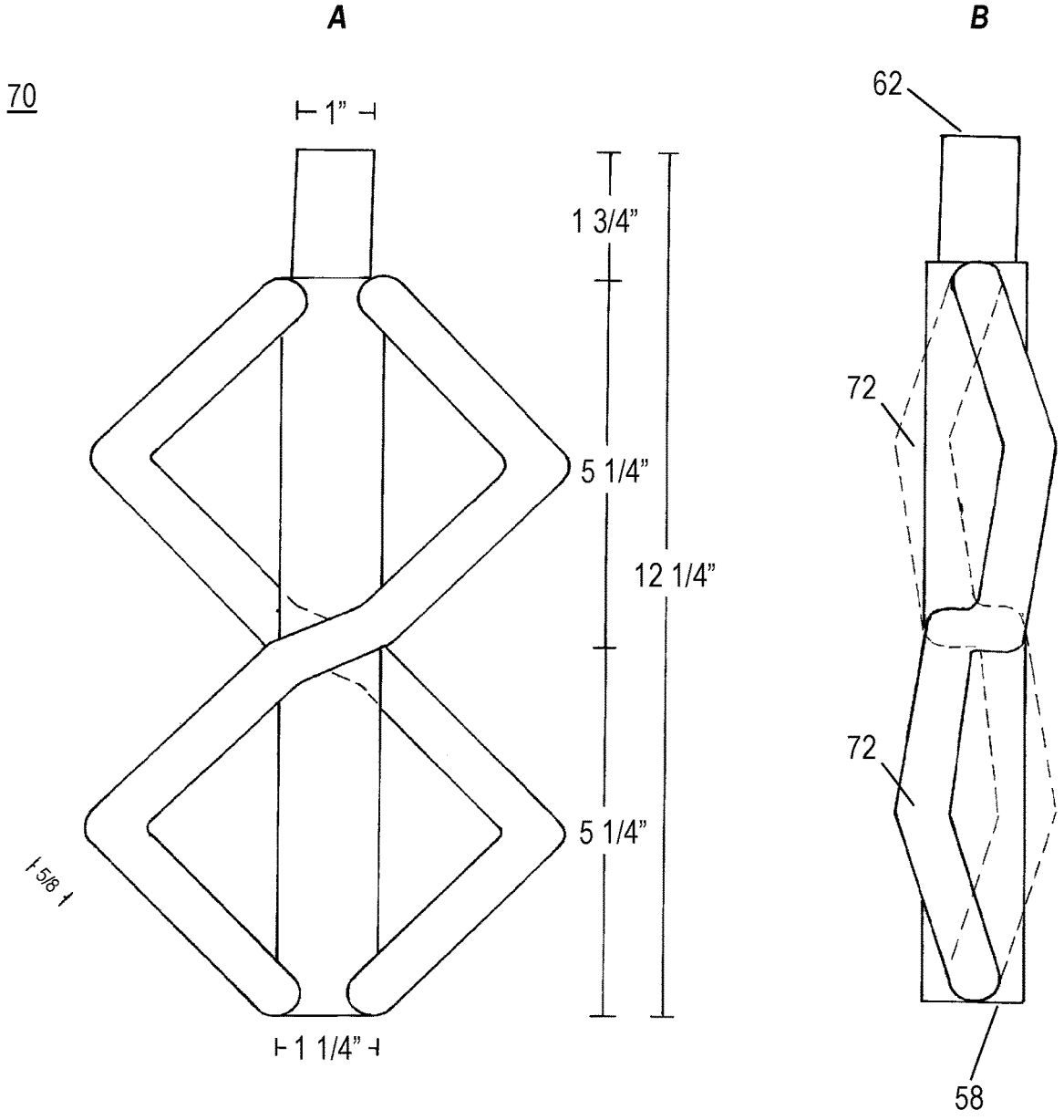
FIG. 10A is a front elevation view of the stabilizing wand including approximate dimensions.
FIG. 10B is a side elevation view of the stabilizing wand.
Figure 11:
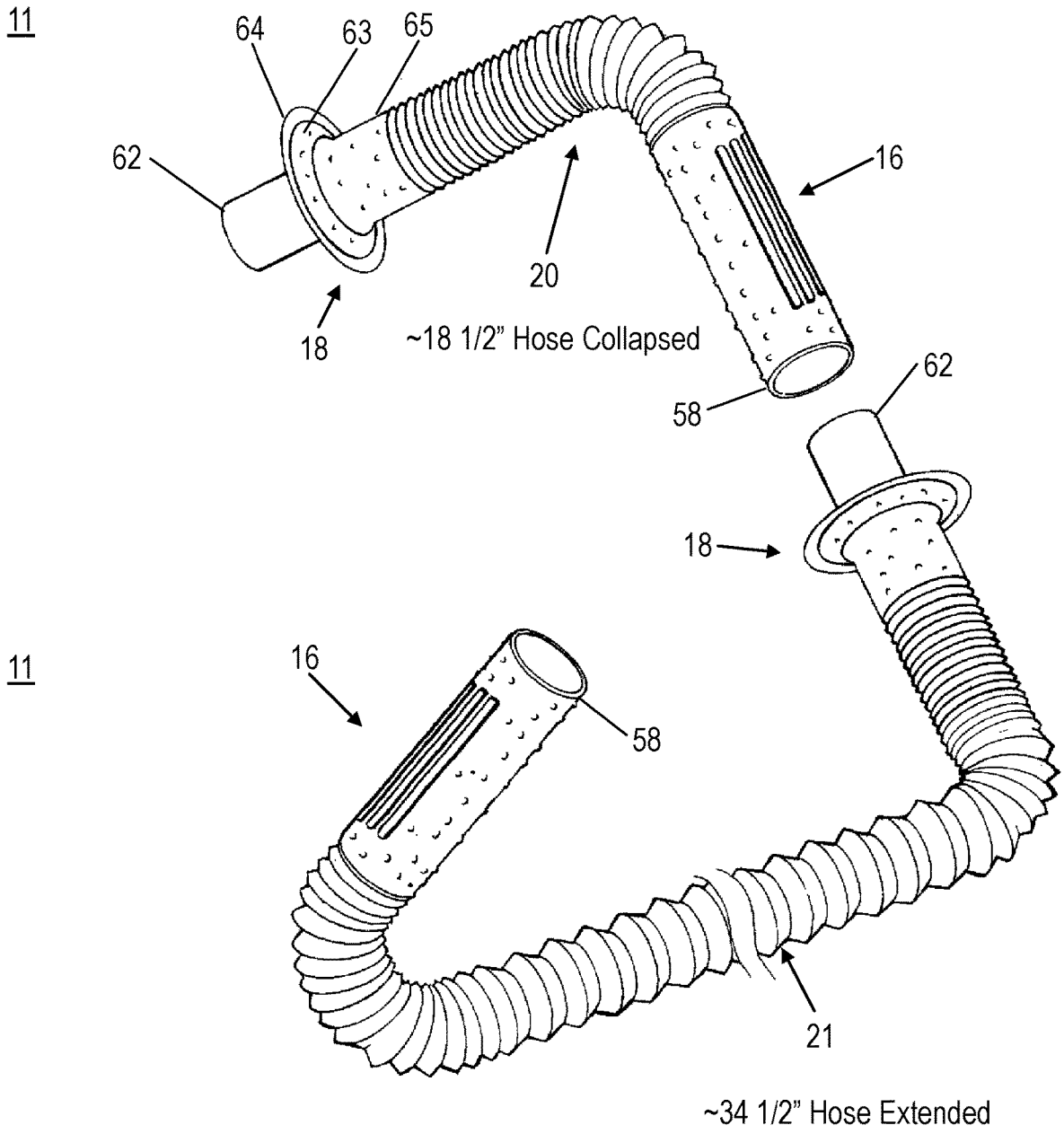
FIG. 11 illustrates an accordion hose vacuum attachment in accordance with the present invention in both partially collapsed and expanded positions and their approximate measurements.

In accordance with the present disclosure, FIG. 1 illustrates preferred embodiments featured in the presented invention. FIGS. 2-8 illustrate embodiments of the vacuum cleaner dusting attachment device 14 which is comprised of a plurality of joining pieces 10, 12, 15, 17, and 19 as described in more detail below, but may include other alternated versions of additional and/or lack of parts and in different combinations of unitary constructions as shown but not limited to the alternate versions shown in illustrations FIGS. 7 and 8. FIGS. 9 and 10 illustrate the manually rotating stabilizing wand 70. FIG. 11 illustrates the main embodiments of the accordion hose vacuum attachment 11 in both a collapsed position 20 for carrying and storage, and in an expanded position 21 where the accordion hose can be extended and bent into position for best cleaning of distant areas.

Figure 6:
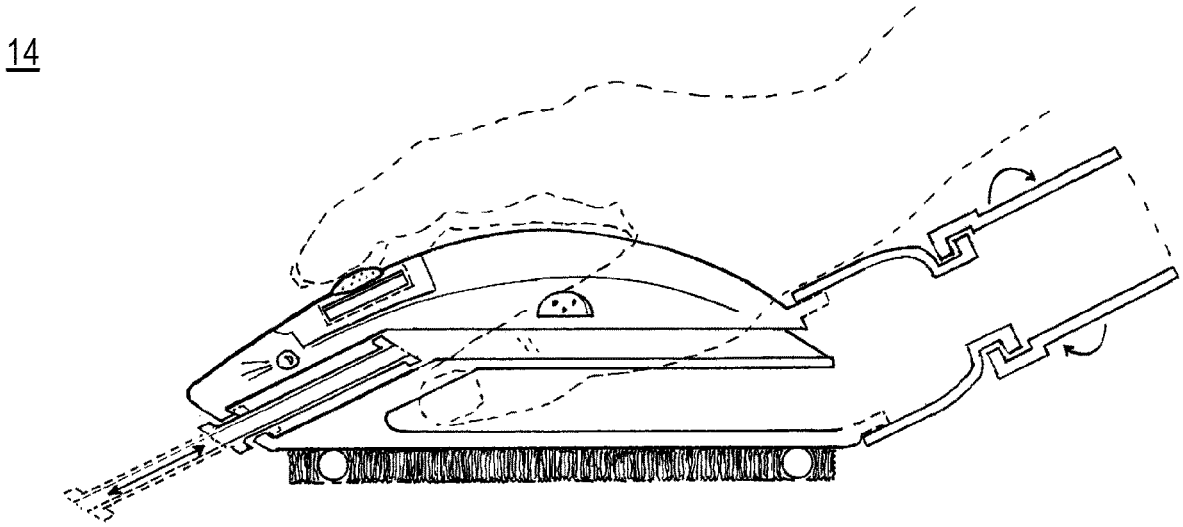
FIG. 6 illustrates in phantom lines a Consumer's hand gripping the vacuum dusting attachment with the palm resting on the front portion and the back of the wrist leaning on the cap.

Referring now in particular to FIGS. 1-6, an embodiment of the vacuum dusting attachment 14 in accordance with the present invention is shown, which includes a main body having a cleaning portion 10, an extendable and retractable crevice tool 12, a cap end component 15, an intake swiveling coupling nozzle 17, and an ergonomically shaped upper portion 19. In FIG. 1 vacuum dusting attachment 14 is shown fully assembled to form a housing except for the side wall panel which is removed in the illustrations for viewing the interior of the device. Detachable cap end component 15, shown detached in FIG. 2, may be used as a separate cleaning attachment separate from dusting attachment 14. In FIG. 3A the approximate measurements of an embodiment of the vacuum dusting attachment 14 convey that the attachment 14 is sized and the outer surface of upper part 19 is curved and ergonomically shaped to accommodate the hand naturally for holding similar to a computer mouse in that, as illustrated in FIG. 6, a Consumer has complete hand control of the attachment while used in close up cleaning, but can also be used for distance cleaning while attached to other vacuum extensions (FIG. 1). The vacuum dusting attachment 14 therefore is ergonomically designed for comfort. FIG. 3B shows the underside of the cleaning portion 10 of the dusting attachment 14 which has an open bottom aperture 42 that leads to lower vent 50, and the position of wheels 55 and brushes 56 of the cleaning portion 10 spaced around the periphery of aperture 42.

Figure 4:
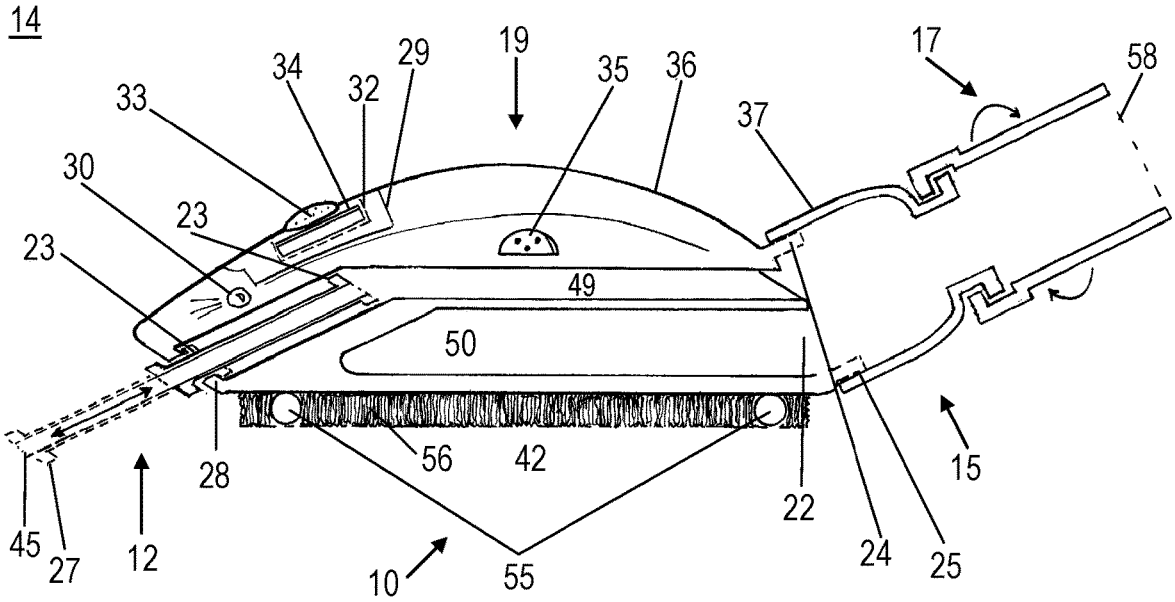
FIG. 4 is another side sectional view showing individual features of the vacuum dusting attachment.
Figure 5:
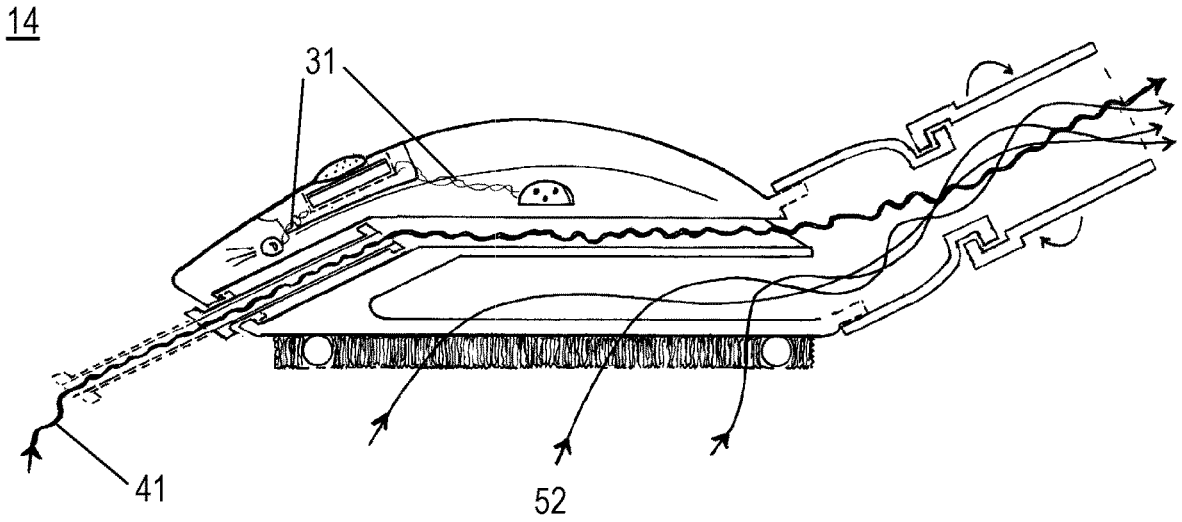
FIG. 5 is another side sectional view illustrating the debris air flow through the vacuum dusting attachment vents.

As presented in FIGS. 1-6 the forward portion of vacuum dusting attachment 14 which includes cleaning portion 10, crevice tool 12, and top portion 19, (see FIG. 2) in itself has a plurality of parts. Pull-out/push-in crevice tool 12 is movably secured in a downwardly angled section of a dedicated enclosed vent or air channel 49 as seen in FIG. 4 which vent 49 provides a first suctioned air path in attachment 14 where debris is suctioned in to vent 49 through the open vent 45 of the crevice tool 12 and which is facilitated through the suction created from a vacuum receptacle the vacuum dusting attachment 14 is attached to and/or other various other attachments in-between leading to the vacuum receptacle. The dirty air inlet or vent 45 of the crevice tool 12 collects debris whether the crevice tool 12 is in a fully extended or pulled-out position, a fully retracted or pushed-in position, or an intermediate position. Tabs 27 are situated on the outside of the crevice tool device 12 and internal rear tabs 23 are provided at the opposite end of the device 12 in vent 49, and along with the interior tabs 28 which are located on the outer shell of the front side of the vacuum dusting attachment 14 where the crevice tool 12 operates, vacuum suction leakage around the edges of the crevice tool 12 is prevented while tabs 23 prevent the crevice tool 12 from completely sliding all the way out from the interior vent chamber 49. A means for securing the crevice tool 12 in an extended or retracted position, not shown, may also be provided and may be in the form of a notch in the wall of the air channel 45 for receiving interior tabs 28 when slidably moved over the notch, or alternatively another suitable locking means may be provided. It might be desirous in an embodiment to attach a screen that covers the front aperture opening 45, but most large debris will be prevented from entering into the narrow opening 45 of crevice tool 12 in vent 49, and if need be, any lodged debris that enters the vent chamber 49 can be removed from the vent at backside opening 22 of the forward portion of device 14 when the forward portion of the vacuum dusting attachment 14 is disconnected from the rear cap portion 15.

Providing tabs 23 and 27 on the opposite ends of the crevice tool 12 and corresponding interior tabs 28 on the front of the vacuum dusting attachment 14 as shown in FIG. 4 necessitates in an embodiment that the forward portion of the device 14 be manufactured in separate pieces. The top area 19 of the forward portion of attachment 14 most likely will be manufactured as one such piece of a solid hard plastic or other suitable material which provides the amount of stability required to allow recessed areas for battery chamber 32 to be formed, a corresponding chamber lid cover 29 with push on/off button 33 added (conveniently located in the center similar to a computer mouse wheel (FIG. 6), open channels for wiring 31 (FIG. 5) to connect the battery 34 to light fixtures 30 on the outer front sides of the forward portion of device 14, an alternate energy recharge pin port 35, and to provide support for a Consumer's hand (FIG. 6). This solid manufactured piece would allow insertion of the crevice tool 12, as well as forming the upper wall of the top vent opening 49. The upper portion 19 and respective side walls would then be attached to the lower cleaning portion 10 to complete the forward portion of the vacuum dusting attachment 14. Ideally, the very top surface of upper portion 19 is coated with a padded and textured soft coating 36 for the comfort of the Consumer's handling of the device while in use. This padded and textured soft coating 37 would also be applied to the top surface of cap end 15 so that it is also comfortable in the Consumer's hand when gripped and used and a separate suction tool.

Debris is also collected by the vacuum dusting attachment 14 from the bottom cleaning portion 10 through aperture opening 42. This open area of the cleaning portion 10 of the vacuum dusting attachment 14 includes a separate vent 50 from the crevice tool vent 49 (see FIG. 4) which by being separated the two individual vents 49 and 50 create a stronger suction power at each vent opening. As debris is collected through both vents 49 and 50 within the vacuum dusting attachment 14, the debris commingles as it exits both vents and continues in and through the cap end 15 of attachment 14 and through to the vacuum receptacle. This collection of debris through the two vents 49 and 50 is indicated by the debris flow lines 41 and 52 in FIG. 5 through their respective vents.

Referring again to FIG. 4, the cleaning portion 10, or bottom portion, of the vacuum dusting attachment 14 and the forward portion, the cleaning portion 10 is also a combination of a plurality of parts. When connected to the upper portion 19, the bottom of vent 49 is now enclosed and forms a top and a base for vent opening 50 while also forming the aperture opening 42 beneath the vent 50 opening (see FIG. 3B). Along the base of the aperture opening 42 and opening of vent 50, brushes 56 are placed extending outwardly along the lower outer edges of the base surrounding the aperture opening 42 to loosen and gather debris off of surfaces to be cleaned using the dusting attachment 14. Since the vacuum dusting device 14 would mostly be used while being grasped or held in a Consumer's hand and corresponding hand pressure, wheels 55 that can rotate 360° while the Consumer presses slightly downwards while cleaning are advantageously provided in a spaced apart fashion along the lower edge of the base, of which the wheels 55 will also help in keeping the vacuum dusting attachment 14 at a correct height to collect debris. The wheels 55 would ideally be of a soft material to prevent scratching delicate surfaces.

When the forward portion of the vacuum dusting attachment 14 is fully assembled, a back opening 22 is created as shown in FIG. 4 that combines the distal ends of vents 49 and 50. The back opening 22 extends outwards to allow the cap end 15 to attach to the forward portion of the vacuum dusting attachment 14. More particularly, the ends of the two pieces 14 and 15 attach together at points 24 on the outer side of the now formed circular back end of the forward portion of the vacuum dusting attachment 14 to the inner end 25 of the circular cap end 15 (FIG. 2), preferably both connection areas 24 and 25 couple together by using a short screw thread coupling method due to pressures that might cause the cap end 15 to become detached when the vacuum dusting attachment 14 is used as a whole unit.

Figure 2:
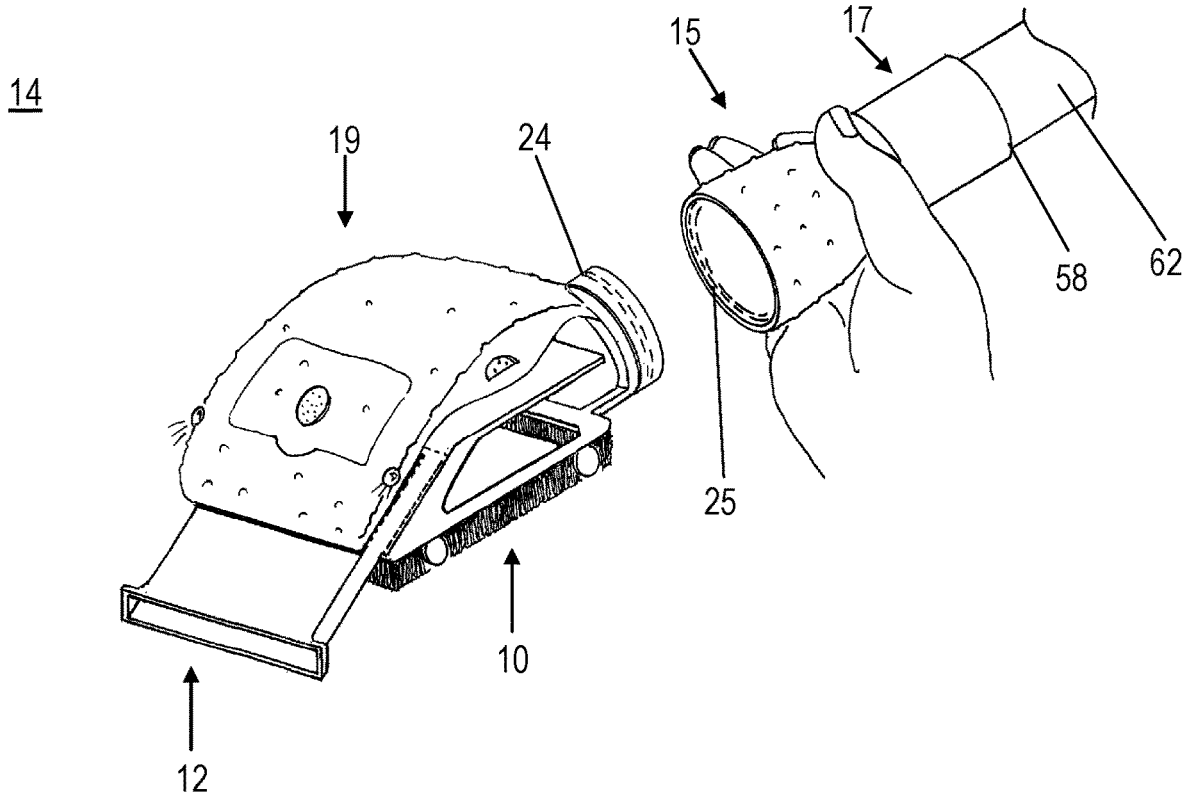
FIG. 2 is another perspective view of the vacuum dusting attachment with a side panel removed for illustrative purposes and with the cap end detached from the front portion of the attachment.
Figure 3:
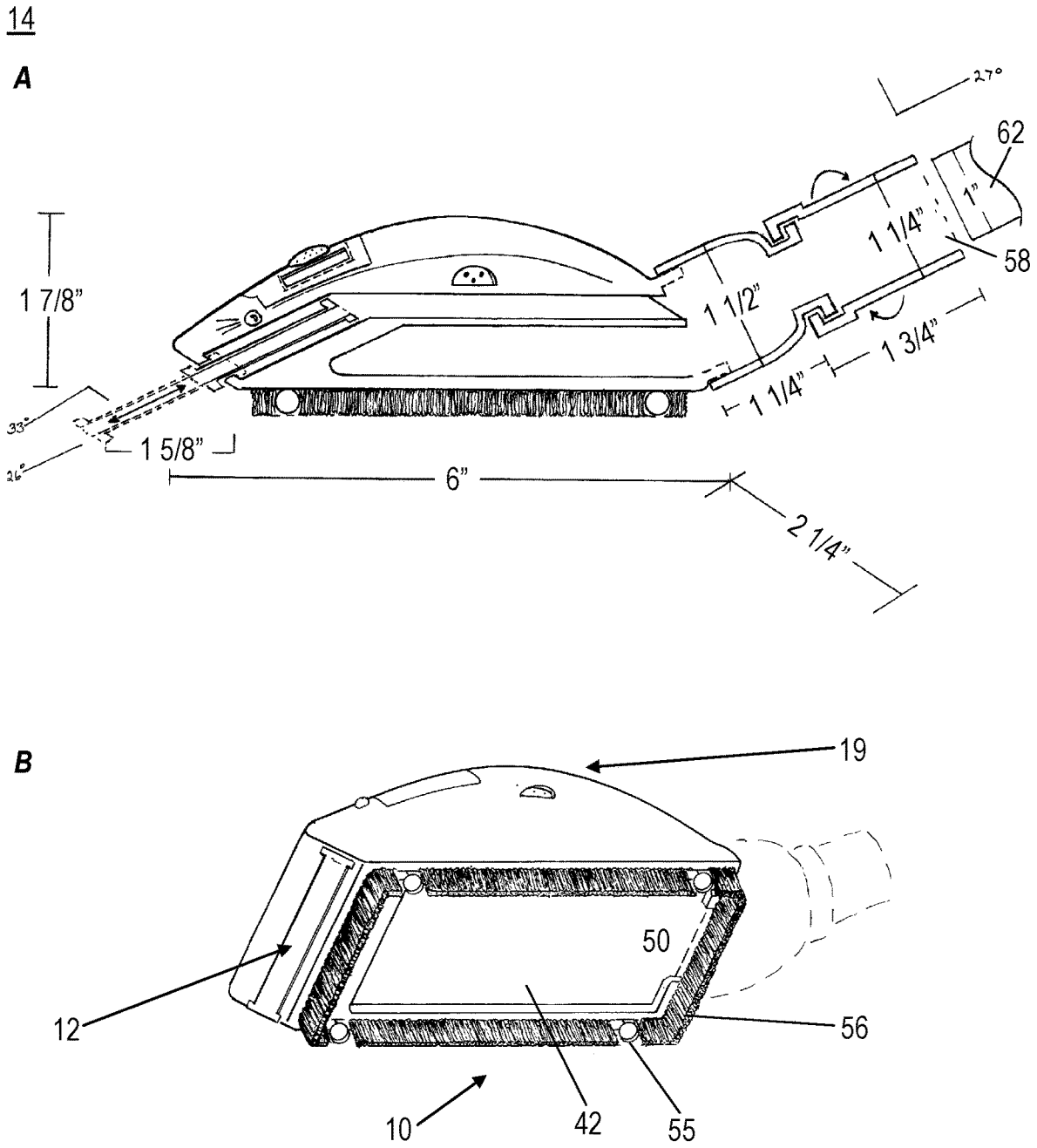
FIG. 3A is a side sectional view of the vacuum dusting attachment showing the approximate measurements of an embodiment of the attachment.
FIG. 3B is a perspective view from the bottom showing the underside of the front portion of the vacuum dusting attachment.

The cap end 15 becomes a third purposed vacuum dusting attachment when detached from the forward portion of the vacuum dusting attachment 14. Used in various ways, the vacuum dusting attachment 14 replaces a vacuum crevice tool, a brushed tool device, and the cap end becomes a brushless tool device when detached as shown in FIG. 2. The backside of the cap end 15 couples internally with an intake hose end of swiveling coupling nozzle 17, to which other vacuum attachments can be attached by inserting their input side hose end 62 into intake coupling nozzle end 58 (FIG. 2) of swiveling coupling nozzle 17. The cap end 15 swivelably connects within intake hose end of coupling nozzle 17 to allow nozzle 17 to spin in any direction while attached to another hose attachment as indicated by arrows in FIG. 4. A similar arrangement is shown in FIG. 8 where an alternate version of device 14 consists of an end hose 17 that has a slight bend allowing for more swiveling movement. This swiveling section of end hose 17 also will include a locking system (not shown) incorporated to lock it in a desired position against swiveling, the details of which locking system will be determined in manufacture production process. It is preferable that all separate attachments are designed to be compatible such that the smaller or insert hose ends 62 fit correctly within the larger intake ends 58 of end hose 17 as indicated in several of the Figures.

Figure 7:
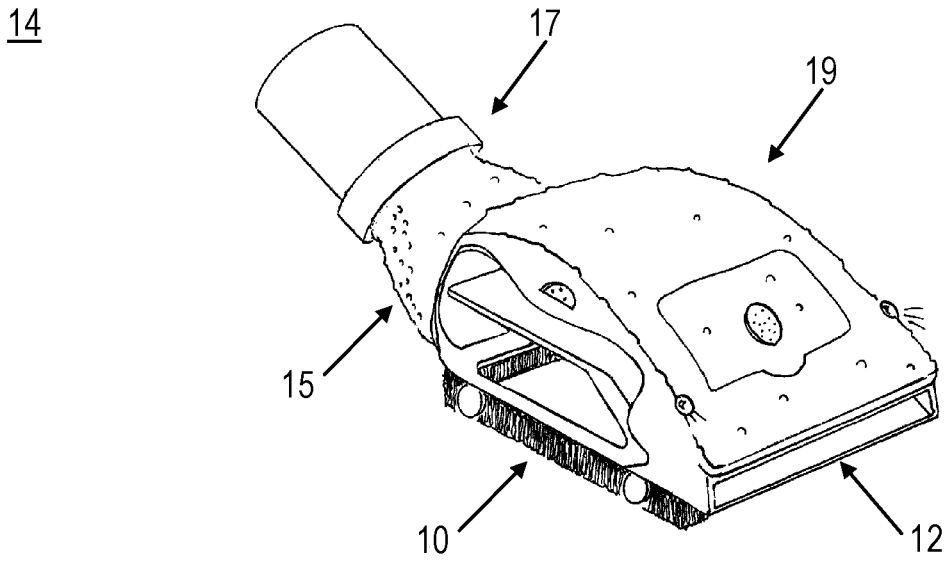
FIG. 7 illustrates an alternate version of the vacuum dusting attachment in which a the pull out/push in crevice tool is eliminated and the front end is slightly elongated as it protrudes out from the attachment body.
Figure 8:
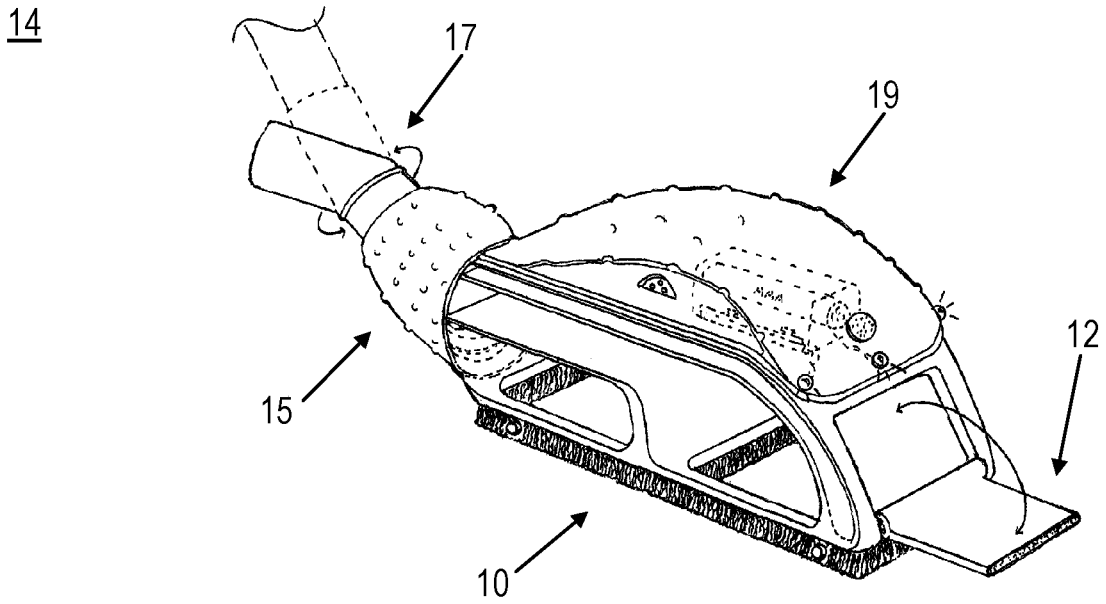
FIG. 8 illustrates another alternative version of the vacuum dusting attachment 14 that has flip out crevice tool, three separate intake vents, and a bent swiveling intake hose end.

FIGS. 7 and 8 present alternate arrangements of the vacuum dusting attachment 14, but it will be understood do not limit other arrangement possibilities. In FIG. 7 the vacuum cleaner dusting attachment is shown having a crevice opening 12 that slightly protrudes from the forward end of the attachment, but does not including an extending and retracting crevice tool as in the previous embodiment. In FIG. 8 the vacuum cleaner dusting attachment is provided with a flip-open crevice tool 12 on the forward end of the body section, which when in an open position provides an dirty air inlet to a dedicated suction channel as in the previous embodiment. In addition, the bottom opening in the dusting attachment is divided laterally into a forward and rearward opening also having separate dedicated suction channels. Thus, the dusting attachment in FIG. 8 features three separate dust collection vents in the cleaning portion 10.

FIG. 9 illustrates another vacuum attachment which can be used with the dusting attachment 14, in the form of a 360° rotating stabilizing wand 70. This vacuum attachment wand 70 includes a rigid conduit or extension rod section having an intake coupling nozzle end 58 and an inserter coupler nozzle end 62. Two handles 72 are attached to the conduit section extending between ends 58 and 62, which handles are attached to the conduit on opposite sides from each other at the ends 58 and 62. Each handle 72 extends along the outer surface of the conduit, spaced apart from the conduit so the handle can be gripped manually as shown in FIG. 9. The handles then twist inwardly on opposite sides of the conduit, and after connecting to the midpoint of the conduit then angle outwardly and upwardly to the opposite end of the conduit, at a location 45 degrees offset from the attachment location on the opposite end, forming a spiraling arrangement. The handles thus twist upwards between the two base or end points towards the center point of the conduit between the two base points, upon which the handles 72 twist again at the midpoint length of the extension rod, and continue upwards bending towards the opposite side of its origin of the beginning base point, creating a twisting handle configuration. These two twisting handles 72 create a tool that allows a Consumer to have instant access to grab an available handle as the attachment 70 rotates while turning the extension hose 360° in a left or right direction. The handles 72 would be covered with a soft padded and textured material while the rod itself also may be padded and textured. In FIG. 10A the rotating stabilizing wand 70 is shown from the front position while FIG. 10B shows the wand 70 from its side. The rotating stabilizing wand does not have to be overly long, as its purpose is to provide a pivotal tool to direct any attachments that are placed above it so as to direct the attachments at the farthest end away from the Consumer. This enables control of the far attached tool so the Consumer does not have to pull the whole assembly of connected attachments back down to the Consumer to adjust the location of the attachment's aperture opening.

In FIG. 11, accordion hose vacuum attachment device 11 is shown, which device 11 is preferably made of a lightweight material and can be expanded, collapsed, or bent to any desired length or shape. In an embodiment, the total expansion of device 11 would be approximately two feet which is considered to be a comfortable width for a Consumer to pull out to expand or push in to collapse the accordion hose using the disk grip 18 and the handle 16. The accordion hose (shown in FIG. 11 and indicating the view 20 of the accordion hose partially collapsed and the view 21 of the accordion hose partially expanded), would be manufactured so the bellow walls would be thick enough to resist collapsing from vacuum suction while extended and to retain any bended direction placed by the Customer. A material for the hose shall have to be rigid, such as but not limited to a plastic material, but yet flexible so as to avoid cracking with repeated usage. The advantage of using the accordion hose is that it is lighter, bendable, and can telescope within its extendable manufactured length, to any length or bend desired as well as reaching specific target areas, and additional accordion hose vacuum attachments of device 11 can be coupled together to add more extension when needed, and there will always be a handle to grasp. The other advantage is that the hose collapses approximately a third of the fully extended hose making the accordion hose vacuum attachment 11 ideal for storage and carrying while cleaning as opposed to using rigid long extension hoses. Using the grip disk 18 and handle 16 makes it easier to pull outwards to expand the length of the hose and push inwards to collapse the hose, while the handle can be used to hold and direct the accordion hose.

The grip disk 18 is made of a sturdy material but is coated with soft material such as the handle 16 featuring the raised bumps and/or ridges for a slip resistant hand purchase, and the outside rim 64 is cushioned for comfort of the hand. The soft material on the disk continues as the disk diminishes to the rounded size area 63 and 65 that corresponds to the circumference of the accordion hose.

Referring again to the accordion hose vacuum attachment device 11 (FIG. 11), it should be noted that if it is attached directly behind the vacuum dusting attachment device 14, it can be raised to reach distant areas, but when close up cleaning is desired and the Consumer is handling the vacuum dusting attachment 14, the accordion hose vacuum attachment allows the Consumer a fluidity of a swinging, extension, and unobstructed movement and added distance behind the Consumer, working as well with other vacuum attachments. The hose attachment can now swing freely as compared to several rigid attachments which do not allow the same fluidity of movement As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

I claim:

1. A multiple tooled dusting attachment device for use with a vacuum cleaning appliance and a conduit in communication therebetween comprising:

a housing including a top portion with a gripping surface ergonomically shaped to be held by a user's hand with the palm resting on an upwardly facing area of the gripping surface, a forward portion, a rear portion, and a bottom portion;

a first air channel defining a first debris flow path extending within the housing between an inlet opening in the forward portion for receiving debris and an exit opening in the rear portion;

a second separate air channel defining a second debris flow path extending within the housing between an inlet aperture in the bottom portion for receiving debris and the exit opening in the rear portion;

a crevice tool slidably mounted in the first air channel in fluid communication with the inlet opening of the first air channel;

a plurality of outwardly directed bristles secured extending around the periphery of the inlet aperture in the bottom portion;

a cap end component connectable on a first end to the rear portion of the housing with an aperture in fluid communication with the exit opening to the first and second air channels; and a swiveling couple nozzle rotatably secured to a second end of the cap end component;

wherein a suction force provided by the vacuum cleaning appliance is generated in the second air channel irrespective of whether the crevice tool is in an extended, retracted, or intermediate position.

2. The dusting attachment device of claim 1 wherein the hand gripping surface is dimensioned and shaped to be held in the user's hand and maneuvered similar to a computer mouse.

3. The dusting attachment device of claim 2 additionally comprising a plurality of 360° rotatable wheels on the bottom portion spaced apart around the inlet aperture such that the housing can be moved on the wheels in any direction supported on a surface without lifting the housing off of the surface.

4. The dusting attachment device of claim 3 in which the cap end component is angled and configured for use as a wrist support when attached to the housing and as a brushless cleaning attachment when detached from the housing.

5. The dusting attachment of claim 4 in which a padded and textured handgrip coating is provided over an outer surface of the cap end component.

6. The dusting attachment device of claim 4 in which a padded and textured handgrip coating is provided on the outer surface of the housing.

7. The dusting attachment device of claim 1 additionally comprising a pair of internal rear tabs on the crevice tool to prevent complete removal of the crevice tool from the first air channel.

8. The dusting attachment device of claim 6 additionally comprising a pair of light fixtures mounted on the forward portion of the housing electrically connected to a battery chamber and on/off switch in the housing.

9. The dusting attachment of claim 8 additionally comprising an alternate energy recharge pin port electrically connected to the battery chamber.

10. A dusting attachment device comprising:

a main body including an upper portion having a curved outer surface, a forward portion having a downwardly angled front wall, a rear portion, and a bottom portion;

a first vent opening in the downwardly angled wall of the forward portion for receiving debris therethrough and connecting to a first air channel in an interior of the main body;

a second vent opening in the bottom portion for receiving debris therethrough and connecting to a second air channel extending in the interior of the main body;

a crevice tool mounted in the first air channel having an interior vent opening in communication with the first vent opening and being linearly extendable outwardly from the first vent opening, a back attachment opening disposed in the rear portion adapted for connecting to a vacuum cleaner, the first and second air channels in fluid communication with the back attachment opening such that when a suction force is generated an air flow and entrained debris is directed through the first and second air channels through the back attachment opening;

the outer surface of the main body ergonomically shaped to facilitate single handed holding and moving of the dusting attachment in any direction on a surface to be cleaned with the hand supported on the outer surface in a horizontally pronated orientation with respect to the main body;

wherein a suction force is generated in the second air channel irrespective of the linear position of the crevice tool.

11. The dusting attachment device of claim 10 additionally comprising a cap end component connectable to the back attachment opening, said cap end component angled and configured for use as a wrist support when attached to the main body and as a handheld brushless cleaning attachment when detached from the main body and connected to the vacuum cleaner.

12. The dusting attachment of claim 10 additionally comprising a plurality of 360° rotatable wheels mounted to a bottom surface of the main body along a periphery of the second vent opening.

13. The dusting attachment of claim 10 additionally comprising a plurality of outwardly directed bristles mounted to the bottom surface along the periphery of the second vent opening.

14. The dusting attachment of claim 11 additionally comprising a swiveling couple nozzle rotatably secured to a second end of the cap end component.

15. The dusting attachment of claim 10 additionally comprising a battery powered light system incorporated into the interior top portion of the main body including an on/off button on the outer surface in a position substantially similar to a computer mouse wheel, a battery chamber, and a plurality of light fixtures on the forward portion of the main body.

* * * * *